US005413161A

United States Patent [19]

Corazzini

[11] Patent Number: 5,413,161

[45] Date of Patent: May 9, 1995

[54] SOLAR POWERED WINDOW SHADE

[76] Inventor: Warren Corazzini, 1375 McCann La., Greenport, N.Y. 11944

[21] Appl. No.: 118,517

[22] Filed: Sep. 9, 1993

[51] Int. Cl.[6] ..... E05F 15/20

[52] U.S. Cl. ..... 160/7; 160/168.1; 160/178.1

[58] Field of Search ..... 160/1, 2, 7, 9, 10, 160/168.1 R, 168.1 P, 168.1 V, 176.1 R, 176.1 P, 176.1 V, DIG. 17, 331, 236, 178.1 R, 178.1 V

[56] References Cited

U.S. PATENT DOCUMENTS

| | | | |
|---|---|---|---|
| 3,390,251 | 6/1968 | Lowenfish | 160/168.1 R X |
| 3,646,985 | 3/1972 | Klann | 160/168.1 P |
| 3,809,143 | 5/1974 | Ipekgil | 160/168.1 P |
| 4,173,721 | 11/1979 | Louis | 160/2 X |
| 4,550,759 | 11/1985 | Archer | 160/176.1 P |
| 4,644,990 | 2/1987 | Webb et al. | 160/176.1 P X |
| 4,664,169 | 5/1987 | Osaka et al. | 160/2 X |
| 4,773,733 | 9/1988 | Murphy et al. | 160/176.1 P X |
| 4,807,686 | 2/1989 | Schnebly et al. | 160/7 X |
| 4,913,214 | 4/1990 | Ming | 160/168.1 P |
| 5,029,428 | 7/1991 | Hiraki | 160/DIG. 17 X |
| 5,040,585 | 8/1991 | Hiraki | 160/DIG. 17 X |
| 5,148,849 | 9/1992 | Faludy | 160/10 X |

*Primary Examiner*—David M. Purol
*Attorney, Agent, or Firm*—Michael I. Kroll

[57] ABSTRACT

A solar powered window shade is provided which consists of a venetian blind mounted within an interior of a frame of a window in a wall of a building. An apparatus is carried by the venetian blind, for converting solar radiation of sunlight into electrical energy. A mechanism is carried by the venetian blind for utilizing the electrical energy to open and close the venetian blind. At sunrise and all through the day, the venetian blind will remain opened to allow sunlight to enter through the window, to help heat up the building. At sunset and all through the night, the venetian blind will remain closed to produce a thermal barrier, to help retain the heat within the building.

4 Claims, 2 Drawing Sheets

SOLAR POWERED WINDOW SHADE

BACKGROUND OF THE INVENTION

1. Field of the Invention

The instant invention relates generally to window coverings and more specifically it relates to a solar powered window shade.

2. Description of the Prior Art

Numerous window coverings have been provided in prior art that are adapted to be mounted onto window frames, such as curtains, draperies, shades, venetian blinds and shutters. While these units may be suitable for the particular purpose to which they address, they would not be as suitable for the purposes of the present invention as heretofore described.

SUMMARY OF THE INVENTION

A primary object of the present invention is to provide a solar powered window shade that will overcome the shortcomings of the prior art devices.

Another object is to provide a solar powered window shade that will open during the day, to allow solar heating in a building and close during the night for a thermal barrier, to hold the heat in the building.

An additional object is to provide a solar powered window shade that will energize a light at night to shine into a room for illumination, so as to make it appear that there is someone in the building for security reasons.

A further object is to provide a solar powered window shade that is simple and easy to use.

A still further object is to provide a solar powered window shade that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
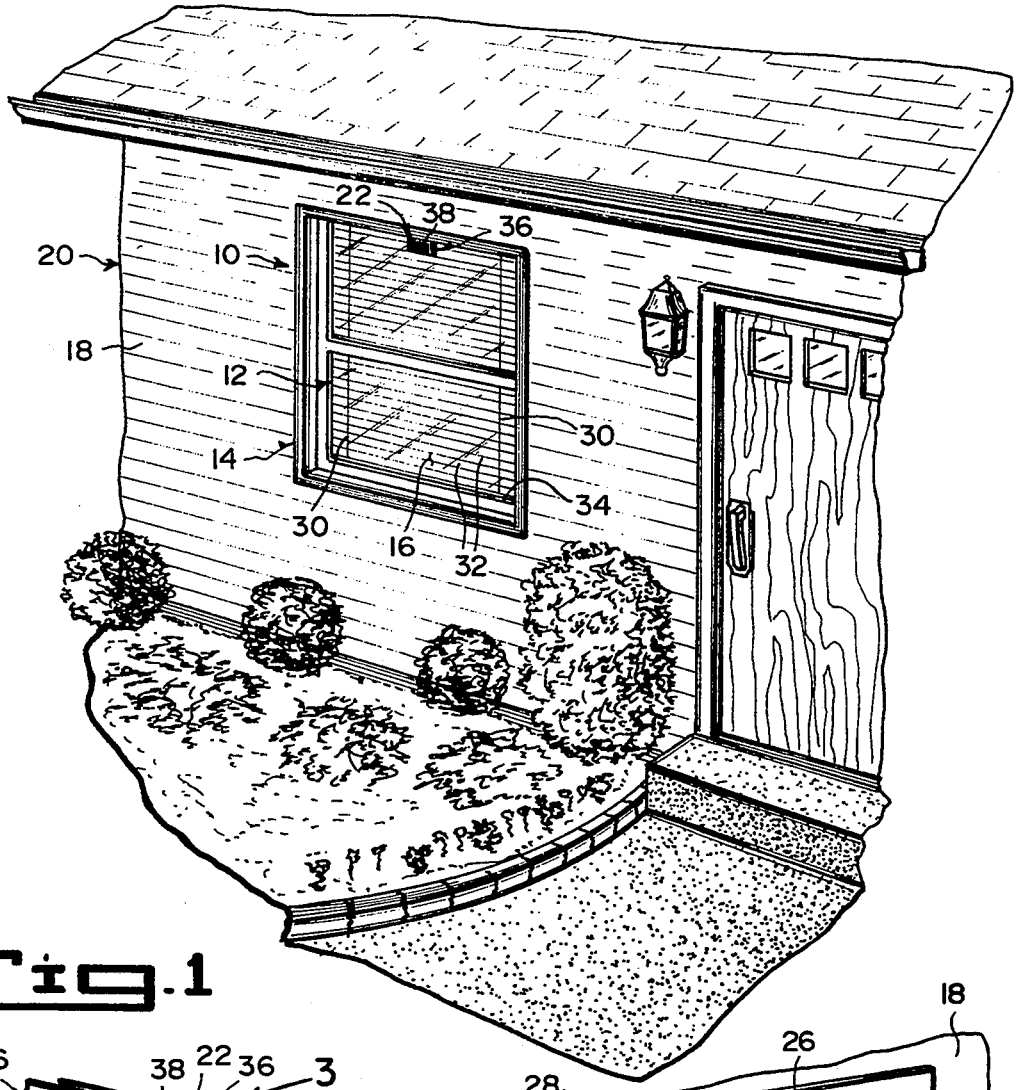
FIG. 1 is a front perspective view of the instant invention mounted inside a window frame in a wall of a building.
Figure 2:
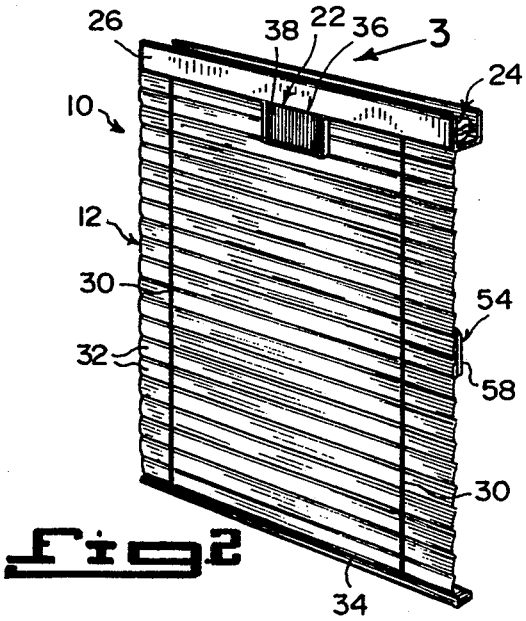
FIG. 2 is a front perspective view of the instant invention per se.
Figure 3:
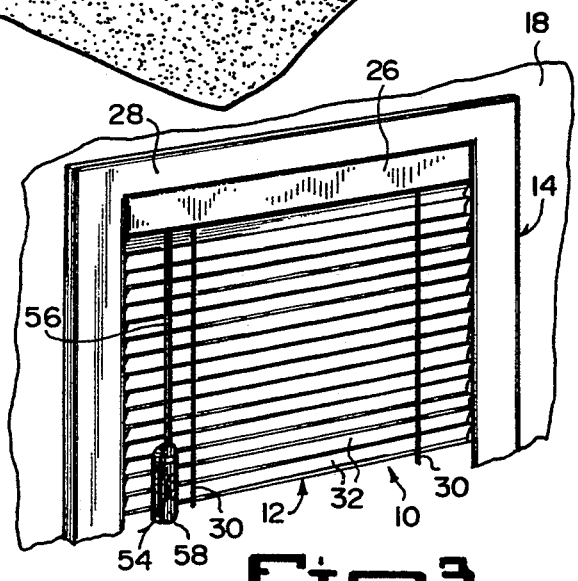
FIG. 3 is a rear perspective view taken in direction of arrow 3 in FIG. 2, in the window frame with the lower portion broken away.

Turning now descriptively to the drawings, in which similar reference characters denote similar elements throughout the several views, FIGS. 1, 2 3 and 5 illustrate a solar powered window shade 10, which consists of a venetian blind 12 mounted within an interior of a frame 14 of a window 16 in a wall 18 of a building 20. An apparatus 22 is carried by the venetian blind 12, for converting solar radiation of sunlight into electrical energy. A mechanism 24 is carried by the venetian blind 12, for utilizing the electrical energy to open and close the venetian blind 12. At sunrise and all through the day, the venetian blind 12 will remain opened to allow sunlight to enter through the window 16, to help heat up the building 20. At sunset and all through the night, the venetian blind 12 will remain closed to produce a thermal barrier, to help retain the heat within the building 20.

The venetian blind 12 contains a head channel 26, affixed horizontally to an underside of a head jamb 28 of the frame 14 of the window 16. A pair of braided ladders 30 are spaced apart and extend vertically down from the head channel 26. A plurality of slats 32 extend horizontally in spaced apart parallel relationships between the braided ladders 30. A bottom rail 34 is affixed horizontally to the braided ladders 30.

The solar radiation converting apparatus 22 includes a solar panel 36, mounted to the head channel 26 facing the window 16, to receive the solar radiation. A plurality of interconnected solar cells 38 are within the solar panel 36. Each solar cell 38 converts the solar radiation into the electrical energy.

Figure 5:
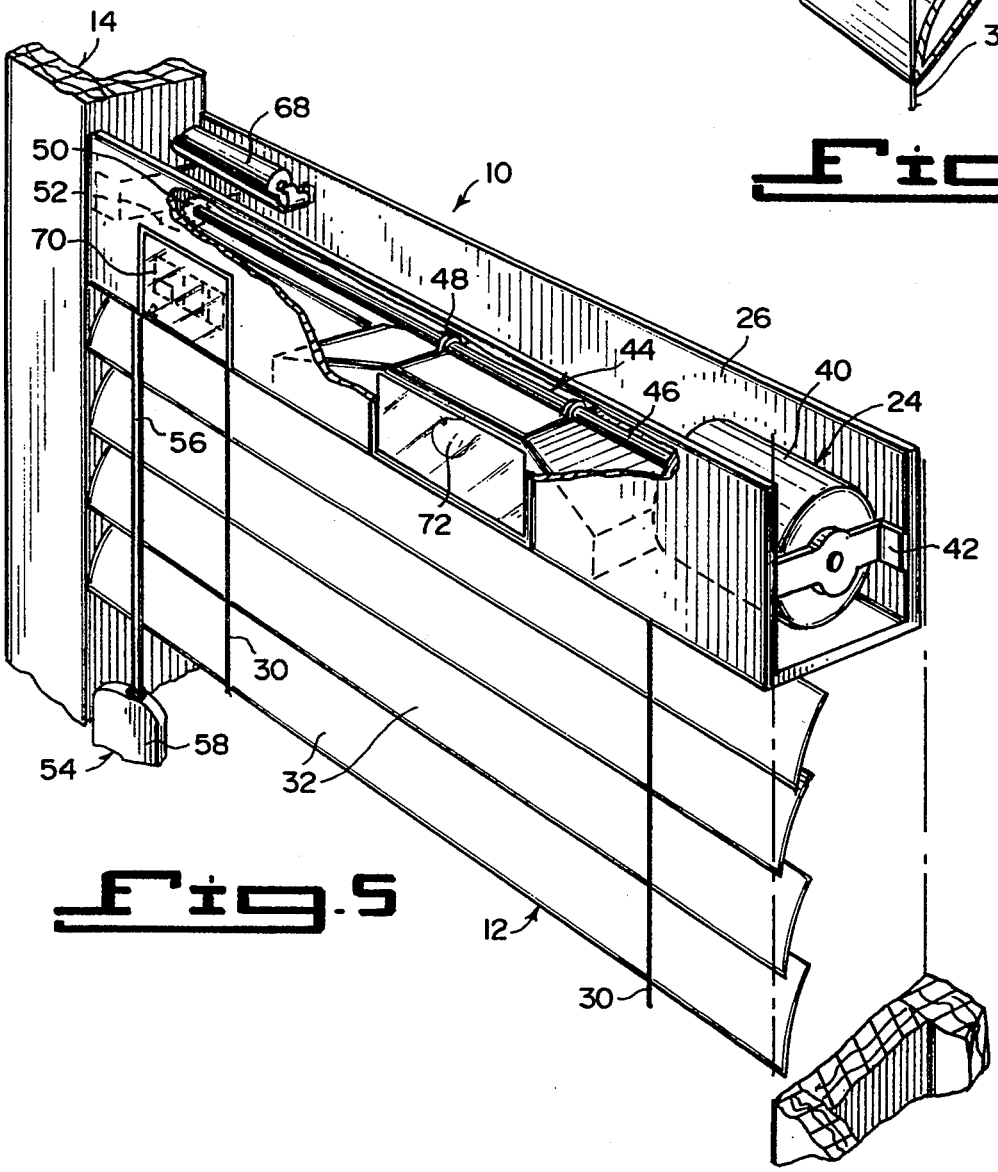
FIG. 5 is a rear perspective view with parts broken away of a modification having a clock and light therein.

The electrical energy utilizing mechanism 24, as best seen in FIG. 5, contains a reversible electric motor 40, mounted within the head channel 26 via a brace 42 and is electrically connected to the solar cells 38 within the solar panel 36, so as to be operated by the electrical energy. A structure 44 is mechanically connected to the motor 40, for opening and closing the slats 32 in the venetian blind 12.

The opening and closing structure 44 includes an elongate tilt rod shaft 46 extending from the motor 40. at least one cradle 48 is in the head channel 26, for rotatively carrying the tilt rod shaft 46. A tilt gear 50 is on a distal end of the tilt rod shaft 46, to operate a tilt mechanism 52 for the slats 32.

Figure 4:
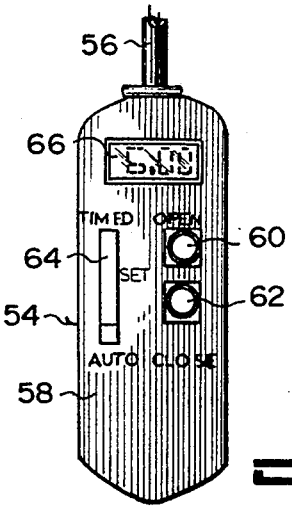
FIG. 4 is an enlarged elevational view of the control unit.

A control unit 54 is electrically connected to the motor 40, so that the motor 40 can be operated both manually and automatically. The control unit 54, as best seen in FIG. 4, includes an elongate electrical cord 56, suspended to heading down from the head channel 26 opposite from the solar panel 36 and is electrically connected to the motor 40. A housing 58 is on a distal end of the electrical cord 56. A first switch 60 is on the housing 58, which when manually pressed will cause the motor 40 to rotate the tilt rod shaft 46 clockwise to open the slats 32. A second switch 62 is on the housing, which when manually pressed will cause the motor 40 to rotate the tilt rod shaft 46 counterclockwise to close the slats 32. An automatic timed set switch 64 is on the housing 58, which will cause the motor 40 to rotate the tilt rod shaft 46 clockwise to open the slats 32 and then cause the motor 40 to rotate the tilt rod shaft 46 counterclockwise, to close the slats 32 at predetermined time intervals. A clock 66 on the housing 58 is used for setting the automatic timed set switch 64.

A battery 68 is carried in the head channel 26 and is electrically-connected to the motor 40, so as to supply auxiliary electrical energy to the motor 40, as a back up, when there is an inclement sunless day. A clock 70 is mounted in the head channel 26, which can be synchronized with the clock 66 in the control unit 54 and can be viewed from within the building 20.

Figure 6:
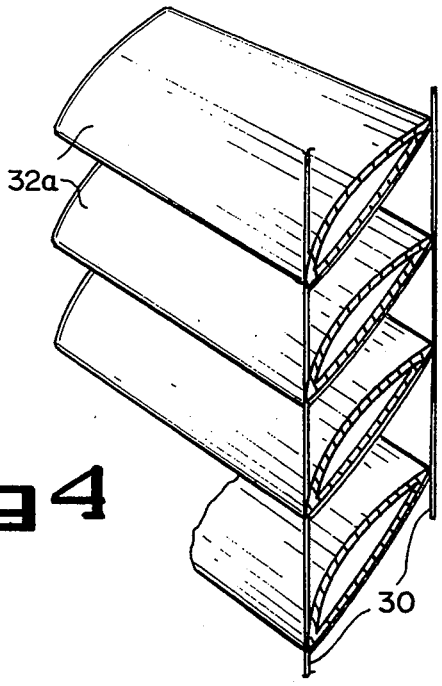
FIG. 6 is a perspective view of a portion of the slats which are insulated to enhance the thermal barrier when in a closed condition.

A light 72 is also mounted in the head channel 26, which can be energized at night to shine into the building 20, so as to make it appear that there is someone in the building 20 for security reasons. Each slat 32*a* can be hollow, as shown in FIG. 6, so that when the venetian blind 12 is closed the hollow slats 32 will produce a better thermal barrier between the venetian blind 12 and the window 16.

LIST OF REFERENCE NUMBERS

10 solar powered window shade
12 venetian blind
14 frame
16 window
18 wall
20 building
22 solar radiation converting apparatus
24 electrical energy utilizing mechanism
26 head channel
28 head jamb of 14
30 braided ladder
32 slat
32*a* hollow slat
34 bottom rail
36 solar panel
38 solar cell in 36
40 reversible electric motor
42 brace
44 opening and closing structure
46 elongate tilt rod shaft from 40
48 cradle in 26
50 tilt gear on 46
52 tilt mechanism
54 control unit
56 elongate electrical cord
58 housing
60 first switch on 58
62 second switch on 58
64 automatic timed set switch on 58
66 clock on 58
68 battery in 26
70 clock in 26
72 light in 26

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A solar powered window shade which comprises:

a) a head channel affixed horizontally to an underside of a head jamb of the frame of a window in a wall of a building, a venetian blind having slats mounted within an interior of said frame below said head channel b) means comprising a solar panel mounted on said head channel facing the window to receive the solar radiation and a plurality of interconnected solar cells within said solar panel, each solar panel converting the solar radiation into electrical energy;

c) means comprising a reversible electric motor mounted within said head channel and electrically connected to said solar cells within said solar panel, so as to be operated by the electrical energy for opening and closing said slats in said venetian blind, so that at sunrise and all through the day, said venetian blind will remain opened to allow sunlight to enter through the window to held heat up the building and at sunset and all through the night said venetian blind will remain closed, to produce a thermal barrier to held retain the heat within the building;

d) control unit means electrically connected to said motor, so that said motor can be operated both manually and automatically, said control unit means comprising an elongate electrical cord suspended to hang down from said head channel, a housing on the bottom end of said electrical cord, said housing containing first switch means which upon being manually pressed will cause said motor to rotate in the direction of opening said slats, second switch means which when manually pressed will cause said motor to rotate in the direction of closing said slats, automatic timed set switch means when activated will cause said motor to rotate in the directions of open and close said slats at predetermined time intervals, and a clock for setting said automatic timed set switch means; and e) battery means carried in said head channel electrically connected to said motor as a back up to supply electrical energy when there is insufficient sunlight.

2. A solar powered window shade as recited in claim 1, further including a clock mounted in said head channel, which can be synchronized with said clock in said control unit means and can be viewed from within the building.

3. A solar powered window shade as recited in claim 2, further including a light mounted in said head channel, which can be energized at night to shine into the building, so as to make it appear that there is someone in the building for security reasons.

4. A solar powered window shade as recited in claim 3, wherein each said slat is hollow, so that when said venetian blind is closed, said hollow slats will produce a better thermal barrier between said venetian blind and the window.

* * * * *